United States Patent [19]

Nakajima et al.

[11] Patent Number: 5,035,595

[45] Date of Patent: Jul. 30, 1991

[54] SPINNERET DEVICE FOR CONJUGATE FIBERS OF ECCENTRIC SHEATH-AND-CORE TYPE

[75] Inventors: Sadaaki Nakajima; Taiju Terakawa, both of Shiga, Japan

[73] Assignee: Chisso Corporation, Japan

[21] Appl. No.: 479,249

[22] Filed: Feb. 13, 1990

[30] Foreign Application Priority Data

Feb. 15, 1989 [JP] Japan ..... 1-35780

[51] Int. Cl.[5] ..... B29C 47/30

[52] U.S. Cl. ..... 425/131.5; 264/171; 425/192 S; 425/463; 425/DIG. 217

[58] Field of Search ..... 264/176.1, 171; 425/131.1, 133.1, 192 S, 463, 464, DIG. 217

[56] References Cited

U.S. PATENT DOCUMENTS

| | | | |
|---|---|---|---|
| 2,931,091 | 4/1960 | Breen et al. | 425/131.5 |
| 2,987,797 | 6/1961 | Breen | 425/131.5 |
| 3,584,339 | 6/1971 | Kamachi et al. | 425/131.5 |
| 4,052,146 | 10/1977 | Sternberg | 425/131.5 |
| 4,406,850 | 9/1983 | Hills | 425/131.5 |
| 4,717,325 | 1/1988 | Fujimura et al. | 425/131.5 |
| 4,875,844 | 10/1989 | Nakajima | 425/131.5 |

FOREIGN PATENT DOCUMENTS

| | | | |
|---|---|---|---|
| 34-667 | 6/1959 | Japan . | |
| 35-2716 | 6/1960 | Japan . | |
| 41-17927 | 10/1966 | Japan . | |
| 44-10484 | 5/1969 | Japan | 425/131.5 |
| 45-27537 | 9/1970 | Japan | 425/131.5 |
| 45-36854 | 11/1970 | Japan | 425/131.5 |
| 46-41403 | 12/1971 | Japan | 425/131.5 |
| 47-21242 | 6/1972 | Japan | 425/131.5 |
| 59-66510 | 4/1984 | Japan . | |
| 62-37126 | 8/1987 | Japan . | |

*Primary Examiner*—Jay H. Woo
*Assistant Examiner*—Khanh P. Nguyen
*Attorney, Agent, or Firm*—Fay, Sharpe, Beall, Fagan, Minnich & McKee

[57] ABSTRACT

A spinneret device for conjugate fibers of eccentric sheath-and-core type, capable of universally corresponding to various polymer-spinning conditions; affording a uniform eccentric extent of the core component; reducing the quality variation of single fibers and also that of fibers with lapse of time; being manufactured by easy works and economically are provided, which device includes cap 1; inlets of stocks 2, 2A; reservoirs 3, 3A; partitioner 4 separating 3 and 3A; filter 6; first distributing plate 7 provided with introducing holoes 8A, 8 for alternately distributing the stocks into front and rear distributing grooves 10A, 10; second distributing plate 9 on the back surface of which the grooves 10A, 10 being parallel, equally spaced and linear are engraved and on the ventral surface of which pressure-controlling holes 11A, 11 are bored; eccentricity-controlling plate 14 on the back surface of which grooves for eccentricity, 15 are engraved and the ventral surface (flat) of which introducing holes 16 for leading the stocks rendered eccentric by the grooves 15 to nozzle plate 17 are provided; the nozzle plate 17 having a flat back surface and spinning holes bored at a position where the holes 11 are concentric with the holes 16; and spacer 12 for forming a narrow and uniform clearance 13 between plate 9 and plate 14; holes 11A being arranged so as to be positioned at the intersection of a square or rectangular lattice; and holes 11 being arranged so as to be positioned at the intersection of two diagonals of the quadrilateral form formed by four adjacent holes 11A.

6 Claims, 4 Drawing Sheets

SPINNERET DEVICE FOR CONJUGATE FIBERS OF ECCENTRIC SHEATH-AND-CORE TYPE

BACKGROUND OF THE INVENTION

1. Field of the Invention

This invention relates to a spinneret device for conjugate fibers of eccentric sheath-and-core type. More particularly it relates to a spinneret device for spinning two kinds of spinning stocks into sheath-and-core type conjugate fibers.

2. Description of the Related Art

Spinneret devices conventionally employed for producing conjugate fibers of eccentric sheath-and-core type have been sometimes almost the same as those having a spinneret for conjugate fibers of concentric sheath-and-core type. A spinneret for conjugate fibers of concentric sheath-and-core type is a circular spinneret device which is composed of a nozzle plate provided with spinning holes for melt-spinning of sheath-and-core conjugate fibers and a distributing plate provided with introducing holes, for distributing a core component and a sheath component into the spinning holes. A space or zone which is not so narrow is formed between the back surface of the nozzle plate and the lower or frontal surface of the distributing plate. The spinning holes and the core component-introducing holes are each arranged in a circular form having the same diameter, and the sheath component-introducing holes are bored either on the inner side or on the outer side of the circular form of the core component-introducing holes. Further, in order to form a small clearance between the core component-introducing holes and the spinning holes, either one of the core component-introducing holes or the spinning holes has a flat surface projection, or the respective core component-introducing holes has a single projection which is inserted into the inlet of the spinning hole. Thus, the core component is individually introduced into the respective spinning holes, and the sheath component staying in the small clearance zone is introduced into the respective spinning holes in a radial form to form conjugate fibers of sheath-and-core type, which are then spun out through the spinning holes.

In order to spin conjugate fibers of concentric sheath-and-core type by means of such a spinneret device, core component-introducing holes and spinning holes are positioned concentrically, while when conjugate fibers of eccentric sheath-and-core type are spun, the distributing plate or the nozzle plate is moved by rotation or angle-displacement so that the core component-introducing holes and the spinning holes are positioned on an optional eccentric axis, and fixed. As to a degree of the eccentricity at that time, there is employed a method of varying an angle of the rotation of the circular arrangement of the core component-introducing holes or the circular arrangement of the spinning holes on the same axis or an eccentric axis thereof.

It is possible to obtain conjugate fibers of concentric or eccentric sheath-and-core type with no problem in the case of a spinneret having a relatively small number of spinning holes arranged in a spinneret. However, if many spinning holes are intended to be arranged, it is impossible to obtain conjugate fibers of concentric or eccentric type having a good uniformity.

Namely, a number of processing steps are not only required for precision cutting for providing projections, resulting in a highly expensive device, but also when the circular arrangement of the core component-introducing holes and that of the spinning holes are subjected to angle-displacement on the same axis, this is possible in the case of only one circular arrangement, but when the above circular arrangements are subjected to angle-displacement on eccentric axis, this is limited by the size of the inlets of spinning holes; hence a precise eccentric cum or a precise boring processing at the eccentric site is required. Further, it is practically impossible to ensure even a space of providing the projections, and also it is difficult to make the density of the spinning holes 5 holes/cm$^2$ or more.

Further, when the clearance between the core component-introducing holes and the spinning holes is narrowed, since the spinneret of the above-mentioned structure allows the sheath component to flow in the periphery of the spinning holes by the flow resistance of the sheath component which occurs in the narrowed clearance zone, the area of the projections should be reduced in order to arrange the spinning holes more densely, and the clearance between the nozzle plate and the back plate in the zone should be more narrowed. Thus there are raised various problems such as contaminants in the spinning stocks are liable to hinder the flow of spinning liquid, and that a long-term or stabilized spinning is not only difficult to be carried out, but also fine projections on the surfaces of the nozzle plate and the back plate are liable to be injured during operations of washing and assembling, to shorten its life.

Further, in the case of spinning conjugate fibers of eccentric sheath-and-core type, it has generally been necessary to reduce the clearance of the narrow zone, when the viscosity of the sheath component polymer is low, while necessary to increase the clearance, when the viscosity is high.

Further, the clearance should be set to an optimum value based upon various spinning conditions such as the kinds and combinations of polymers used as the core component and the sheath component, spinning temperature, the quantity of the polymers extruded, etc. Thus, in the case of conventional spinneret devices having a fixed clearance in the narrow zone, it has been necessary to employ different spinneret devices each time these conditions are changed.

As a device for solving the above-mentioned problems, the present inventors have proposed a spinneret device disclosed in Japanese patent application laid-open No. Sho 62-37126/1987. However, this device is directed to a device for producing conjugate fibers of concentric sheath-and-core type; thus it has been impossible to produce conjugate fibers of eccentric sheath-and-core type using the device.

SUMMARY OF THE INVENTION

The object of the present invention is to provide a spinneret device for spinning conjugate fibers of eccentric sheath-and-core type stably and over a long term, having a superior uniformity of fineness of single fibers, an optional eccentricity and cross-section of core component and no conjugate unevenness; capable of corresponding to broad spinning conditions for various kinds of raw stocks for fibers; having a simple structure; being simple in operation; and capable of improving the productivity of the conjugate fibers by arranging a number of spinning holes within the full surface of the nozzle plate.

The present inventors who have made extensive research on the spinneret device for conjugate fibers of eccentric sheath-and-core type in view of the present status thereof, have found that by devising a specific combination of the spinning holes and grooves for eccentricity in the spinneret, it is possible to attain the above object, and accomplish the present invention.

The present invention resides in a spinneret device for conjugate fibers of eccentric sheath-and-core type comprising, for example a cap having inlet holes for introducing a sheath component stock and a core component stock for conjugate fibers, respectively, into the device;

stock reservoirs for receiving the both component stocks respectively;

a filter for filtering the stocks, which is provided between the reservoirs and a first distribution plate;

a first distributing plate provided with introducing holes for alternately distributing said stocks passing through said filter into distributing grooves, which plate also serves as a support for said filter;

a second distributing plate on the back surface of which parallel, equally spaced and linear distributing grooves are engraved, and on the ventral surface of which pressure-controlling holes for leading the stocks distributed in said distributing grooves to an eccentricity-controlling plate are provided;

an eccentricity-controlling plate on the back surface of which a plurality of grooves for eccentricity are engraved and arranged in a fixed pattern and on the ventral surface of which introducing holes are provided so that the center thereof is positioned eccentrically in the plane form or projection of the groove for eccentricity, and the sheath component and core component stocks rendered eccentric by said grooves for eccentricity are led therethrough to a nozzle plate;

a nozzle plate having a flat back surface through which spinning holes extend at positions where they are concentric with said core component pressure-controlling holes and said introducing holes; and a spacer for forming a narrow and uniform clearance between said second distributing plate and said eccentricity-controlling plate;

said sheath component pressure-controlling holes extending through the lower or front surface of said second distributing plate and arranged so as to be positioned at the intersection of a square or rectangular lattice; and said core component pressure-controlling holes being arranged so as to be positioned at the intersection of two diagonals of the quadrilateral form formed by four adjacent sheath component pressure-controlling holes.

DETAILED DESCRIPTION OF PREFERRED EMBODIMENTS

The present invention will be described in more detail by way of drawings, but it should not be construed to be limited thereto.

Figure 1:
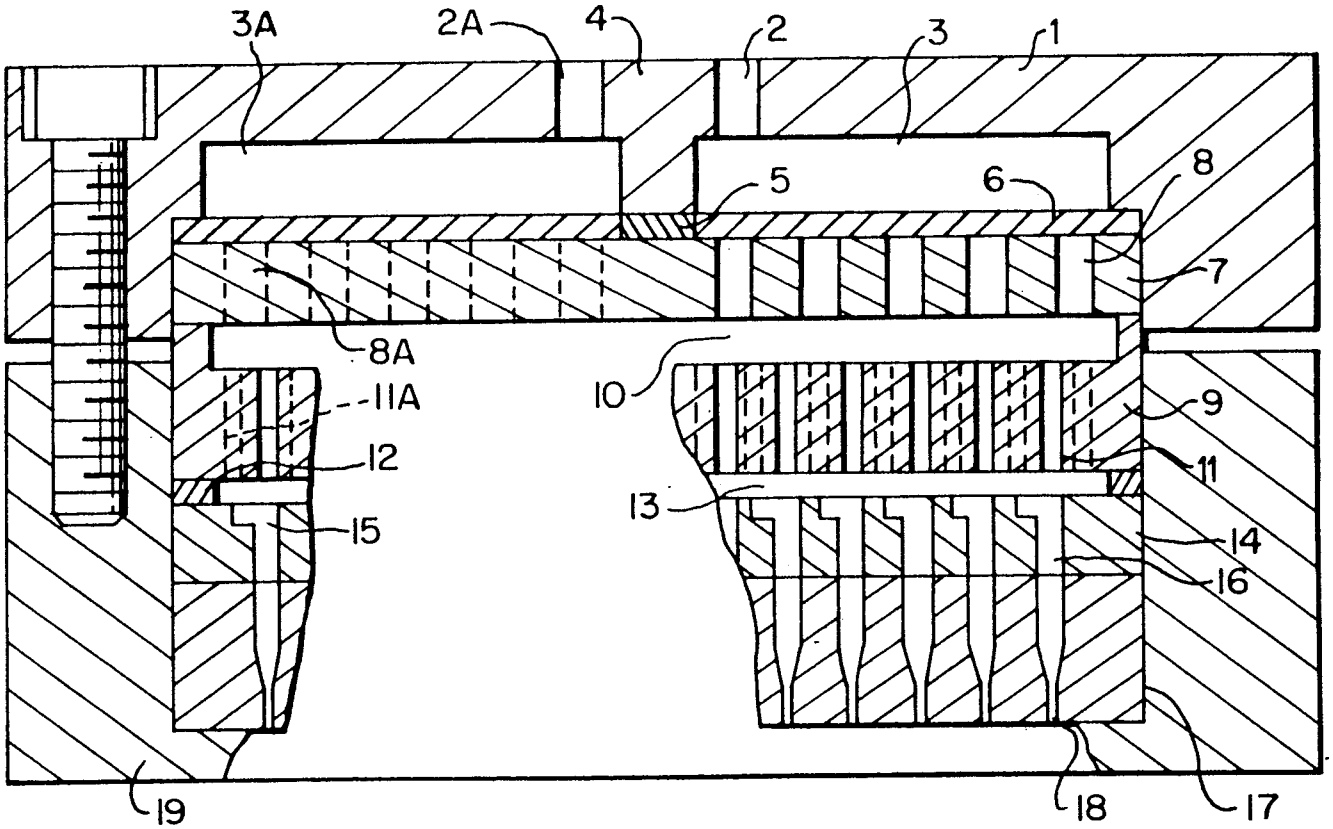
FIG. 1 shows a cross-sectional view (partly omitted) of a spinneret device for conjugate fibers of eccentric sheath-and-core type illustrating an embodiment of the present invention.

The device of FIG. 1 comprises:

a cap 1 having inlet holes 2A and 2 for introducing a sheath component stock and a core component stock for conjugate fibers, respectively, into the device;

stock reservoirs 3A and 3 for receiving both component stocks, respectively, which are provided by dividing a space inside the cap by a partition 4;

a filter 6 for filtering the stocks; which is provided between the reservoirs and a first distribution plate mentioned eater;

a first distributing plate 7 provided with introducing holes 8A and 8 for alternately distributing the stocks passing through the filter into distributing grooves 10A and 10 of a second distributing plate 9 mentioned later, which plate also serves as a support for the filter 6;

a second distributing plate 9 on the back surface of which parallel, equally spaced and linear distributing grooves 10A and 10 are engraved and on the front surface of which pressure-controlling holes 11A and 11 extend therethrough for leading the stocks distributed in the distributing grooves 10A and 10 to an eccentricity-controlling plate 14;

the eccentricity-controlling plate 14 on the back surface of which a plurality of grooves for eccentricity, 15, are engraved and arranged in a fixed pattern and on the front surface of which introducing holes 16 are provided so that the center thereof is positioned eccentrically in the plane form or projection of the groove for eccentricity, 15, and the sheath component and core component stocks rendered eccentricity by the grooves for eccentricity, 15 are lead therethrough to a nozzle plate 17;

the nozzle plate 17 having a flat surface through which spinning holes 18 extend at positions where they are concentric with the core component pressure-controlling holes 11 and the sheath component-introducing holes 16 of the eccentric controlling plate 14; and a spacer 12 for forming a narrow and uniform clearance 13 between the second distributing plate 9 and the eccentricity-controlling plate 14.

Figure 2:
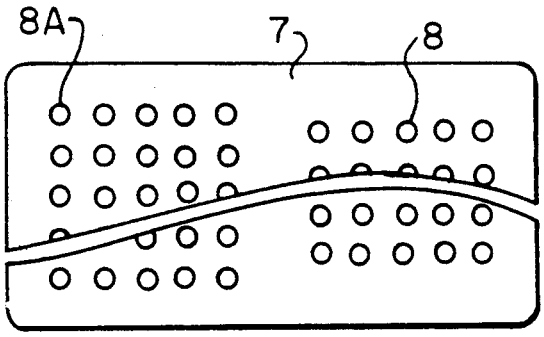
FIG. 2 shows a view illustrating the back surface of a first distributing plate in FIG. 1.
Figure 3:
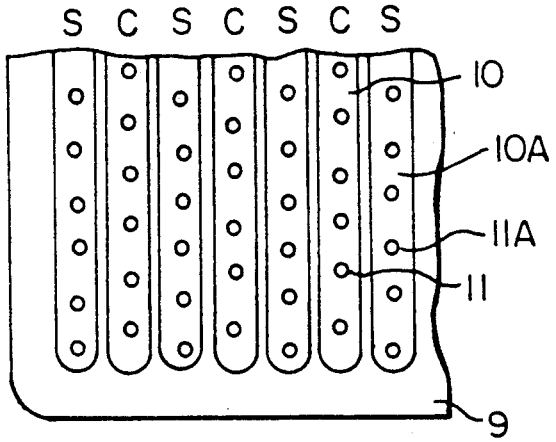
FIG. 3 shows a partial view illustrating the back surface of a second distributing plate in FIG. 1.
Figure 4:
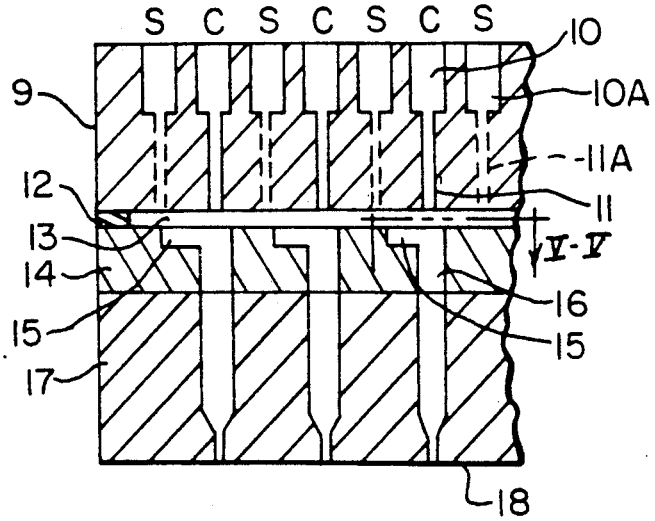
FIG. 4 shows a cross-sectional view illustrating the relationship among the second distributing plate, a spacer, an eccentricity-controlling plate and a nozzle plate.

The first distributing plate 7 functions to support the filter 6, and also has core component-introducing holes 8 and sheath component-introducing holes 8A for distributing and feeding each of the corresponding components to core component-distributing grooves 10 and sheath component-distributing grooves 10A engraved substantially in parallel and at an equal distance on the back surface of the second distributing plate 9 (FIG. 2). In the second distributing plate 9, the core component distributing grooves 10 and the sheath component-distributing grooves 10A are alternately positioned and the first row and the final row are both allotted to the sheath component-distributing grooves grooves 10A (FIG. 3).

Figure 5A:
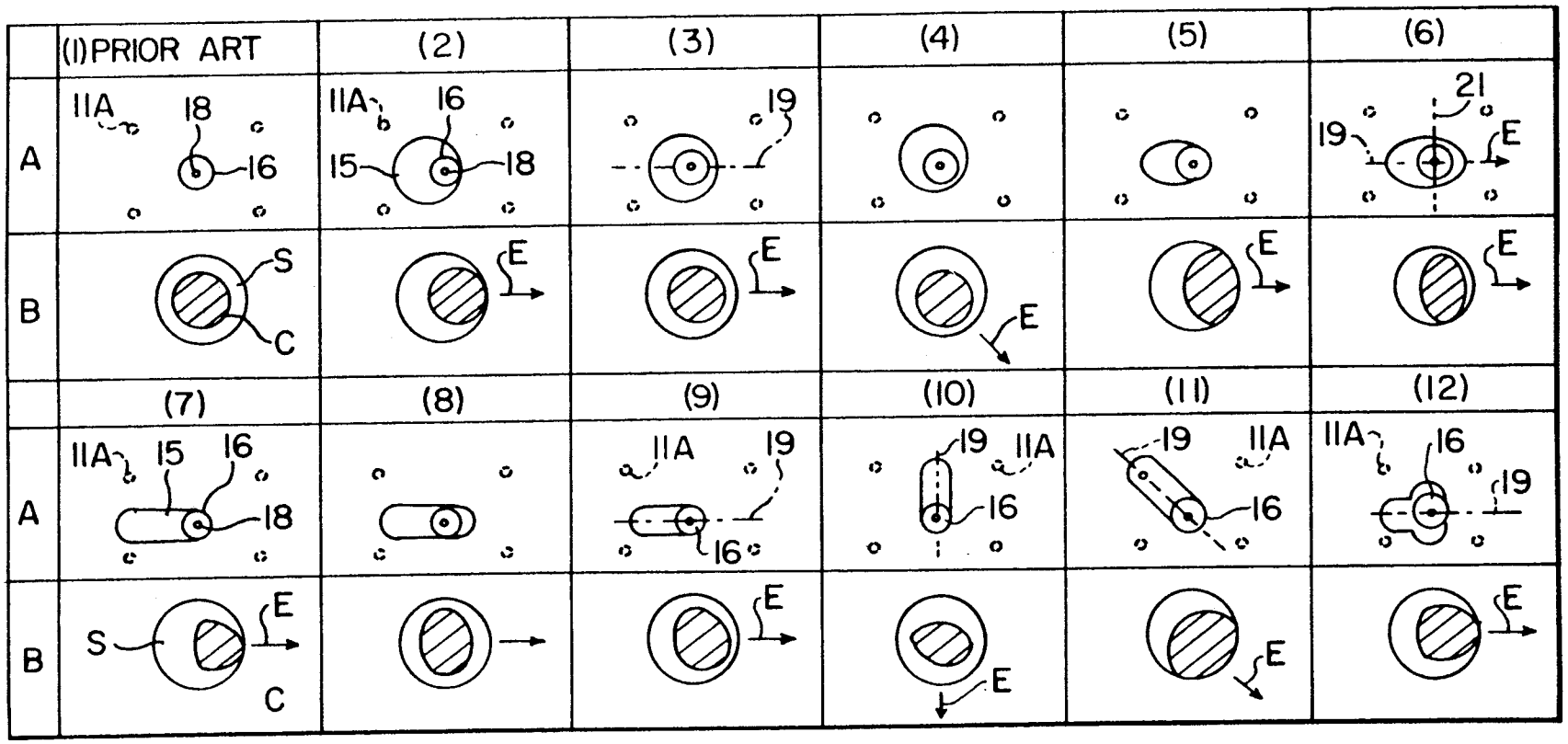
FIG. 5(A) and 5(B) show partial plan views of eccentricity-controlling plates having various forms of grooves for eccentricity, taken along line V—V in the direction of the arrow shown in FIG. 4, and corresponding cross-sectional views of conjugated fibers obtained by using the above-mentioned eccentricity-controlling plates.
Figure 5B:
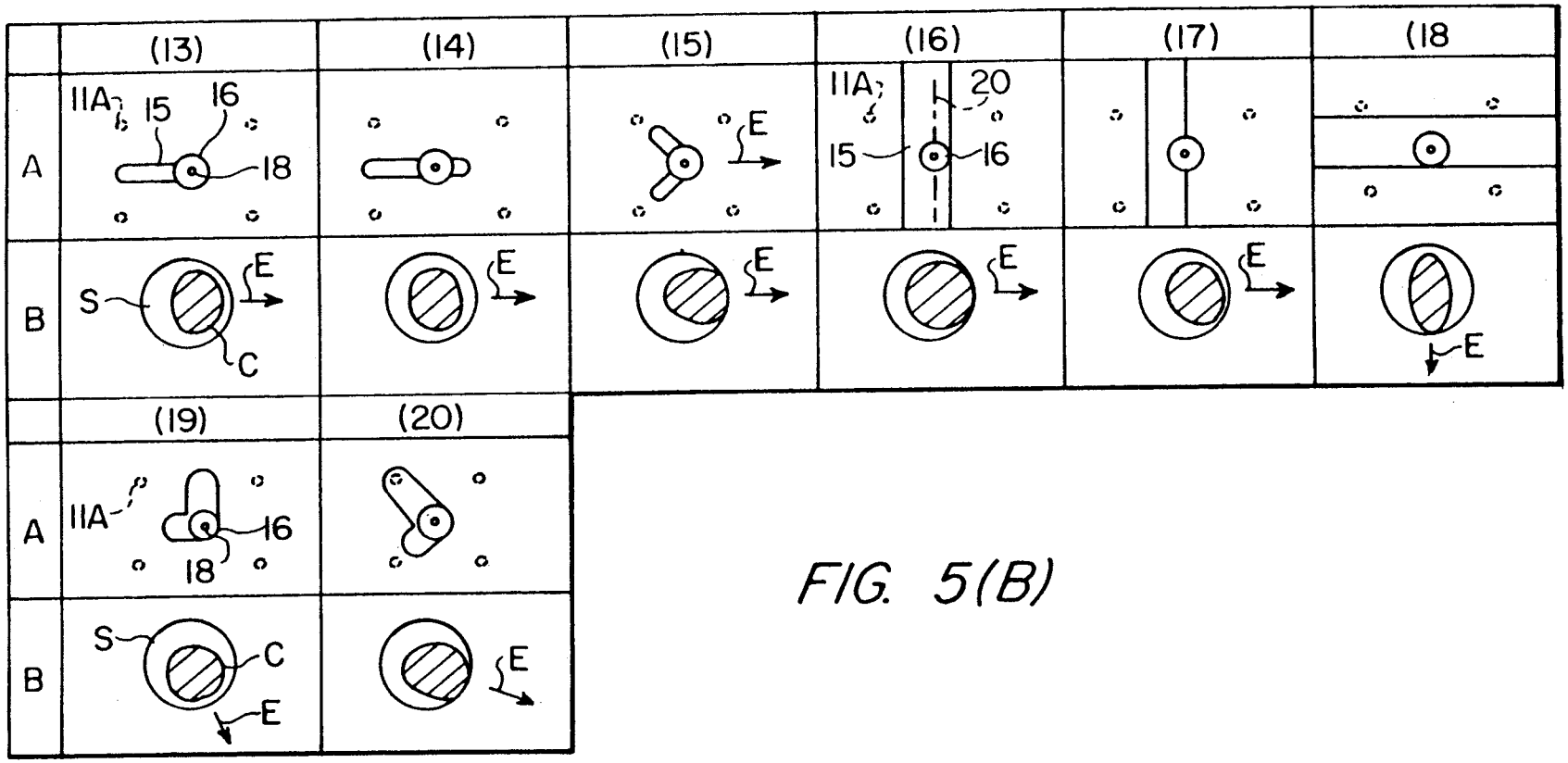

On the front or lower surface of the second distributing plate 9, the sheath component pressure-controlling holes or sheath liquid pressure control holes 11A are arranged so as to be positioned at the intersection of a square or rectangular lattice as shown in FIG. 5, and the core component pressure-controlling holes or core liquid pressure control holes 11 are arranged so as to be positioned at the intersection of two diagonals of a quadrilateral formed by four adjacent sheath component pressure-controlling holes 11A. In the eccentricity-controlling plate 14, grooves for eccentricity 15 in the same number as that of the spinning nozzles 18 in the nozzle plate 17 positioned under the plate 14 are engraved in the same form so as to give a definite breadth R in a direction counter to an eccentric direction E as shown in FIG. 5, and introducing holes 16 are bored at a position on the same axis with that of the core component pressure-controlling holes 11 in the second distributing plate 9. Further, in the nozzle plate 17, spinning holes 18 are bored at positions on the same axis as that of the introducing holes 16 in the eccentricity-controlling plate 14.

In such a construction, core component C and sheath component S introduced into the device through inlet holes 2 and 2A provided independently and separately in the cap 1, respectively; are led to the respective stock reservoirs 3 and 3A partitioned by a partition 4; pass through a filter 6 having a partitioning zone 5; and reach the first distributing plate 7.

The core component (designated as C) and the sheath component (designated as S) fed by the first distributing plate to the respective distributing grooves 10 and 10A of the second distributing plate 9 pass through the core component pressure-controlling holes 11 and the sheath component pressure-controlling holes 11A bored at the respective bottoms of the distributing grooves 10 and 10A, and are discharged from the ventral surface of the second distributing plate 9 into a narrow zone 13.

The sheath component discharged from the sheath component pressure controlling holes 11A is filled in the narrow zone 13, then flow in the grooves for eccentricity, 15 in a large amount to the breadth part R thereof and presses the core component in a eccentric direction E to form a deformed core component; and flow in the spinning holes 18 while enveloping the core component discharged from the core component pressure-controlling holes 11; and extruded in the form of conjugate fibers of eccentric sheath-and-core type.

The first specific feature of the present invention consists in that any of the first distributing plate 7, the second distributing plate 9, the eccentricity-controlling plate 14 and the nozzle plate 17 are manufactured only by a linear or relatively simple channeling processing and/or a perforating processing, and the back surfaces and the front surfaces thereof are flat and have neither projection nor grooves of complicated form. By means of such a structure, it is possible to arrange a large number of spinning nozzles in a high density and to manufacture a spinneret with a good precision by a relatively simple work and economically, and further the resulting spinneret is hardly damaged, has a long life and requires no close attention to handling. The density of the spinning holes 18 can be 5 holes/$cm^2$ or more.

The second specific feature of the present invention consists in that in the second distributing plate 9, the sheath component pressure-controlling holes 11A are arranged at the intersections of squares or rectangular forms; the core component pressure-controlling holes 11 are arranged at the intersections of two diagonals of quadrilateral forms formed by an adjacent four of the sheath component pressure-controlling holes 11A; and the respective axes of the introducing holes 16 of the eccentricity-controlling plate 14 and the spinning holes 18 of the nozzle plate 17 are made the same as the axis of the core component pressure-controlling holes 11. Due to such a structure, it is possible to provide a broad clearance between the front surface of the second distributing plate 9 and the back surface of the eccentricity-adjusting plate 14. Thus, there occurs no clogging of the clearance with contaminants in the spinning liquid and a long time, stable operation becomes possible.

The third specific feature of the present invention consists in that by choosing the plane form or projection of the grooves for eccentricity 15 of the eccentricity-controlling plate 14, it is possible to adjust the cross-sectional form of the core component easily, and also it is possible to obtain conjugate fibers of eccentric sheath-and-core type having a superior uniformity in the fineness between single filaments and having no conjugate unevenness.

The fourth specific feature of the present invention consists in that by choosing the degree of eccentricity of the grooves for eccentricity 15 of the eccentricity-controlling plate 14, it is possible to adjust easily the eccentricity of the cross-section of the core component of the conjugate fibers and also it is possible to obtain conjugate fibers having a superior uniformity in the degree of eccentricity.

The fifth specific feature of the present invention consists in that the clearance 13 between the front surface of the plate 9 and the back surface of the plate 14 is variable and by exchanging the spacer 12, it is possible to optionally set the clearance 13. That is, when the viscosity of the sheath component molten polymer is lower, the clearance is desired to be large, and when the viscosity is higher, it is desired to be small. So it is preferable to set the value of the clearance to an optimum one based upon the kinds and combinations of the core component and the sheath component and various spinning conditions such as spinning temperature, quantities of the components extruded, etc. In the case of conventional spinnerets wherein the clearance 13 corresponding to the spacer 12 is fixed, it has been necessary to employ separate spinnerets each time the above spinning conditions vary.

Whereas, in the case of the spinneret of the present invention, since the spacer 12 which is made cheaply can be exchanged, it is possible to adjust the clearance 13 easily and optionally, and also it is possible to correspond to broad spinning conditions using a single spinneret body; hence the present spinneret is very economical.

In the device of the present invention, the above-mentioned spacer 12 is preferred to have a thickness of 0.15 to 0.7 mm, the above-mentioned grooves for eccentricity, 15 are preferred to each have a depth of 1 to 5 mm, and the area of the plane of the grooves for eccentricity is preferred to be 10 to 90% of the area of the quadrilateral form formed by connecting the central points of four adjacent sheath component pressure-controlling holes 11A, within the latter area.

If the thickness of the spacer is less than 0.15 mm, contaminants contained in the stocks are liable to hinder the flow of the sheath and core components to make difficult a long-term and stabilized spinning, while if it exceeds 0.7 mm, the pressure of the sheath component applied to the core component in the clearance becomes non-uniform to lose the uniformity in the eccentricity of the conjugate fibers.

Further, if the depth of the above grooves is less than 1 mm, when the sheath component flowing from the sheath component pressure-controlling holes 11A into the narrow zone 13 spreads in all directions, the difference in the flow quantity is difficult to control. Thus, a sufficient eccentricity of the core component is often not obtained. Further, if the depth of the grooves exceeds 5 mm, the pressure of the sheath component applied to the core component in the introducing holes 16 of the eccentricity-controlling plate 14 becomes non-uniform, so it is often impossible to obtain conjugate fibers having a uniform eccentricity.

Further, if the above proportion of the area is less than 10%, when the core component flowing from the core component pressure-controlling holes 11 of the second distributing plate 9 into the narrow zone 13 spreads in all directions, the difference of the flow quantity is hardly made. Thus a sufficient eccentricity of the core component is difficult to obtain. Further, if it exceeds 90%, the eccentricity of single fibers cannot become uniform. Further, conjugate fibers having the core component exposed on the surface are often obtained depending on the position of the grooves for eccentricity, 15.

FIG. 5 shows views illustrating embodiments of the plane forms of grooves for eccentricity, 15 and cross-sections of conjugate fibers corresponding thereto.

The cross-sectional form of the conjugate fiber of the present invention becomes symmetric or asymmetric relative to a straight line extending in the eccentric direction E, depending on the plane form or projection of the groove for eccentricity, 15.

The plane form of the groove 15 is provided as follows:

(a) The grooves 15 are engraved in the same number as that of the introducing holes 16 and so that the plane form of the grooves 15 is made symmetric or asymmetric relative to the straight line 19 in the eccentric direction E passing through the central point of the introducing holes 16 as shown in FIG. 5, or (b) The grooves 15 are engraved in the same number as that of the rows of the introducing holes 16 arranged side by side in either the front and rear or right and left directions as viewed in the figure, and so that the plane form of the grooves 15 is made asymmetric relative to the straight line 20 connecting the central points of the introducing holes 16 as shown in column (16) of FIG. 5, for example.

The symmetric cross-sectional form of the conjugate fiber obtained by using the spinneret in the case of (a), varies depending on the arrangement of the sheath component pressure-controlling holes 11A in the second distributing plate 9. In the case where the arrangement of holes 11A is of a rectangular form as shown in FIG. 5 (10), for example, there is employed an eccentricity-controlling plate wherein symmetric grooves 15 relative to the straight line 19 connecting the central points of the introducing holes 16 in the direction of front and rear are engraved. In the case where the arrangement of holes 11A is of a square form as shown in FIG. 5 (11) or (12), for example, there is employed an eccentricity-controlling plate wherein symmetric grooves 15 relative to the straight line 19 connecting the central points of the introducing holes 16 in the direction of right and left (FIG. 5 (12)) or front and rear or diagonal (FIG. 5 (11)) are engraved.

Thus, by choosing the plane form of the grooves for eccentricity, 15 in the eccentricity-controlling plate 14, it is possible to easily control the cross-sectional form of the core component C, and it is also possible to obtain conjugate fibers of eccentric sheath-and-core type having a good uniformity of fineness between single fibers and having no conjugate unevenness.

In FIG. 5, (1) is directed to a case of a conjugate fiber of concentric sheath-and-core type (prior art); (2) to (15) and (19) to (20) are directed to cases of conjugate fibers of eccentric sheath-and-core type are obtained according to the above (a); particularly, (19) to (20) are the cases where the grooves 15 is made asymmetric relative to the straight line 19 connecting center points of introducing holes 11A in the eccentric direction E, while (2) to (15) are the cases where the grooves 15 is made symmetric; and (16) to (18) are directed to cases of conjugate fibers of eccentric sheath-and-core type according to the above (b). When an eccentricity-controlling plate having the form of the grooves 15 engraved into a circular form is employed, conjugate fibers wherein the core component has a circular cross-section are obtained (FIG. 5 (2) to (4)). When an eccentricity-controlling plate having the form of grooves 15 engraved into an elliptical form is employed, conjugate fibers wherein the core component has an elliptical cross-section are obtained (FIG. 5 (5) to (6)). When eccentricity-controlling plate having the form of grooves 15 engraved into a rectangular form is employed, conjugate fibers having a cross-section wherein the core component is pressed in the longitudinal direction of the rectangle and deformed, are obtained (FIG. 5 (7) to (11), (13) and (14)). Further, the form of grooves 15 may be a L-letter form or a T-letter form as shown in FIG. 5 (12), (15), (19) and (20). In these cases, conjugated fibers a cross-section corresponding to the respective forms of the grooves, are obtained.

As described above, the groove 15 is usually formed extending from the introducing hole 16 towards a direction counter to an eccentric direction E. The eccentricity of the core component C is determined by the form of the groove 15. In the case of the groove having a L-letter form, the eccentric direction E is to be determined by a resultant force of two pressing forces of the sheath components in both sides of L-letter groove.

Further, the eccentric direction E is defined as a direction perpendicular to a straight line 21 passing through the central point of the introducing hole 16 in the plate 14 and from the largest area side to the smallest area side of the line 21 which is obtained by dividing the plane area of the groove 15 so that the largest area part and the smallest area part are obtained, as shown in FIG. 5 (6), for example.

The eccentricity of the core component in the conjugate fiber can be adjusted by varying the ratio of the larger area part to the smaller area part in the plane area of the groove 15.

As the ratio of the larger area part/the smaller area part comes close to 1, the eccentricity becomes smaller, and when the grooves 15 are engraved in only one side of the divided line 21, the grooves for eccentricity affords conjugate fibers of eccentric sheath-and-core type rendered most eccentric.

According to the present invention, the following effectiveness is obtained:

(1) By choosing the plane area or projection of the grooves 15 in the eccentricity-controlling plate 14, it is possible to control the degree of eccentricity of the core component of the conjugate fiber in a large extent, and it is also possible to obtain conjugate fibers of eccentric sheath-and-core type having a good uniformity.

(2) It is possible to manufacture a spinneret device having a number of spinning holes arranged in a high density, with relatively simple construction and with good accuracy. The thus obtained spinneret device is economical, not easily damaged, has a long life and requires little close attention.

(3) Since a narrow zone 13 having a very broad width is provided, it is possible to prevent clogging of the narrow zone 13 due to contaminants from occurring to make possible a long-term and stabilized operation.

(4) The narrow zone 13 is variable by exchanging the spacer 12 which is cheaply manufactured. Thus, it is possible to easily and optionally change the clearance of the narrow zone 13 to correspond to broad spinning conditions by using one spinneret device body. Thus, the spinneret device of the present invention is very economical.

What is claimed is:

1. A spinneret assembly for forming conjugate fibers of eccentric sheath-and-core type, comprising:

means forming a core liquid reservoir and a separate sheath liquid reservoir;

a first distribution plate having a plurality of parallel introducing through holes, with a first plurality of said introducing holes being in fluid communication with said core liquid reservoir and a second plurality of said introducing holes being in fluid communication with said sheath liquid reservoir;

a second distribution plate being parallel to said first distribution plate;

a filter for filtering said core and sheath liquids, respectively, disposed between said first distribution plate and said reservoir forming means, wherein said first distributing plate supports said filter;

said first and second distribution plates having means forming therebetween a plurality of parallel separate grooves, with a first plurality of said grooves in fluid communication with said first plurality of introducing holes on the side of said first distribution plate opposite from said core liquid reservoir and a second plurality of said grooves in fluid communication with said first plurality of introducing holes on the side of said first distribution plate opposite from said core liquid reservoir and a second plurality of said grooves in fluid communication with said second plurality of introducing holes on the side of said second distribution plate opposite from said sheath liquid reservoir;

said second distribution plate having a plurality of through core liquid pressure control holes communicating on one side with said first plurality of grooves and further having a plurality of through sheath liquid pressure control holes communicating on one side with said second plurality of grooves;

a spinning plate spaced from and parallel to said second distribution plate;

an eccentricity-controlling plate having a flat surface engaging a flat surface of said spinning plate on one side thereof and having a plurality of grooves for eccentricity on the other side thereof, said spinning plate having a fixed pattern of a plurality of through spinning holes and said eccentricity-controlling plate having a plurality of core liquid introducing holes coaxial with said through spinning holes and with said core liquid pressure control holes, respectively;

said second distribution plate and said eccentricity-controlling plate having adjacent flat parallel unobstructed surfaces interrupted only by said holes and grooves for eccentricity to form therebetween a narrow continuous mixing zone for combining said core liquid and sheath liquid;

a spacer for forming said mixing zone between said distribution plate and said eccentricity-controlling plate;

said sheath liquid pressure control holes entering into said mixing zone in a fixed pattern arranged in position of a rectangular lattice; and said core liquid pressure control holes entering into said mixing zone in a fixed pattern arranged in position at an intersection of two diagonals of a quadrilateral formed by four adjacent sheath liquid pressure control holes of the rectangular lattice.

2. A spinneret assembly according to claim 1, wherein said spacer has a thickness of 0.15 to 0.7 mm.

3. A spinneret assembly according to claim 1, wherein in said grooves for eccentricity have a depth of 1 to 5 mm and the area of projection of each of said grooves is 10 to 90% of the area of the quadrilateral of four adjacent sheath liquid pressure control holes.

4. A spinneret assembly according to claim 1, wherein each said groove for eccentricity has one of said core liquid introducing holes and the projection of each said groove is symmetric relative to a straight line in a direction of eccentricity that passes through a central point of the respective one of said introducing holes.

5. A spinneret assembly according to claim 1, wherein each of said grooves for eccentricity has one of said core liquid introducing holes and the projection of each of said grooves for eccentricity is asymmetric relative to a straight line extending in a direction of eccentricity and passing through a central point of a respective one of said core liquid introducing holes.

6. A spinneret assembly according to claim 1, wherein said grooves for eccentricity are arranged in the same number as that of rows of said introducing holes so that said grooves for eccentricity are asymmetric relative to a straight line connecting central points of said core liquid introducing holes.

* * * * *